US012060753B2

(12) United States Patent
Witte et al.

(10) Patent No.: US 12,060,753 B2
(45) Date of Patent: Aug. 13, 2024

(54) INJECTOR TILT SAFETY METHOD AND APPARATUS

(71) Applicant: PREMIER COIL SOLUTIONS, INC, Waller, TX (US)

(72) Inventors: M. Brett Witte, Waller, TX (US); Randall Dean Behrens, Sealy, TX (US); Michael Bailey, Waller, TX (US)

(73) Assignee: PREMIER COIL SOLUTIONS, INC

( * ) Notice: Subject to any disclaimer, the term of this patent is extended or adjusted under 35 U.S.C. 154(b) by 128 days.

(21) Appl. No.: 17/956,422

(22) Filed: Sep. 29, 2022

(65) Prior Publication Data

US 2023/0101082 A1 Mar. 30, 2023

Related U.S. Application Data

(60) Provisional application No. 63/249,640, filed on Sep. 29, 2021.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 5,660,235 A * 8/1997 Sola ..... E21B 19/22 166/85.5
7,284,618 B2 * 10/2007 Geddes ..... B65H 75/4413 166/85.5
7,469,755 B2 * 12/2008 Borst ..... E21B 19/22 166/384
8,752,617 B2 * 6/2014 Borst ..... E21B 19/22 166/77.2
9,316,067 B1 * 4/2016 Lu ..... E21B 19/22
9,574,411 B2 * 2/2017 Behrens ..... E21B 19/22
9,587,450 B2 * 3/2017 Behrens ..... F16M 11/2021
9,988,864 B2 * 6/2018 Behrens ..... B66C 1/485
10,662,719 B2 * 5/2020 Fossheim ..... E21B 19/22
11,746,927 B2 * 9/2023 Sergison ..... B28B 1/001 137/615
2016/0040488 A1 * 2/2016 Behrens ..... F16M 11/2021 166/77.2

FOREIGN PATENT DOCUMENTS

CA 3040109 A1 * 4/2018 ..... B60P 1/025

* cited by examiner

*Primary Examiner* — Aaron L Lembo

(74) *Attorney, Agent, or Firm* — Hunton Andrews Kurth LLP

(57) ABSTRACT

The present application pertains to a coiled tubing injector system. The system comprises a coiled tubing injector; an injector tilt configured to be mounted to a trailer wherein the injector tilt is configured to receive the coiled tubing injector; a securing mechanism to secure the coiled tubing injector to the injector tilt; and a sensor configured to detect whether the securing mechanism is positioned to substantially secure the coiled tubing injector to the injector tilt. Advantageously, the system is configured such that the injector can only be tilted if the sensor detects that securing mechanism is positioned to substantially secure the coiled tubing injector to the injector tilt.

10 Claims, 3 Drawing Sheets

INJECTOR TILT SAFETY METHOD AND APPARATUS

CROSS-REFERENCE TO RELATED APPLICATIONS

This application claims priority to U.S. Provisional Application No. 63/249,640 filed on Sep. 29, 2021 which application is incorporated by reference herein. The application is also related to U.S. Pat. Nos. 9,587,450; 9,752,413; 9,828,026; 9,988,864; 10,132,154; 10,350,954; 10,422,193; 10,487,596; 10,508,531 all of which are hereby incorporated by reference.

FIELD OF THE INVENTION

This invention relates to methods and apparatuses related to storing a coiled tubing injector, namely the prevention of movement of the coiled tubing injector while mounted in the supporting structure on a coiled tubing trailer.

BACKGROUND AND SUMMARY

Coiled Tubing is a relatively new technology for the oil and gas industry. It is used for interventions in oil and gas wells and production tubing. Previous to the introduction of Coil Tubing, wirelining was used to complete similar operations. The most common application is deliquification, and the dispersement of fluids to a specific location in the well through tubing feed through an injector.

While coiled tubing is effective in many applications, what is needed are additional cost effective methods and apparatuses. It would further be beneficial if such cost-effective method and apparatuses improved the safety of employees working in and around the equipment Advantageously, the present application relates to such cost-effective methods and apparatuses.

DETAILED DESCRIPTION

Figure 1:
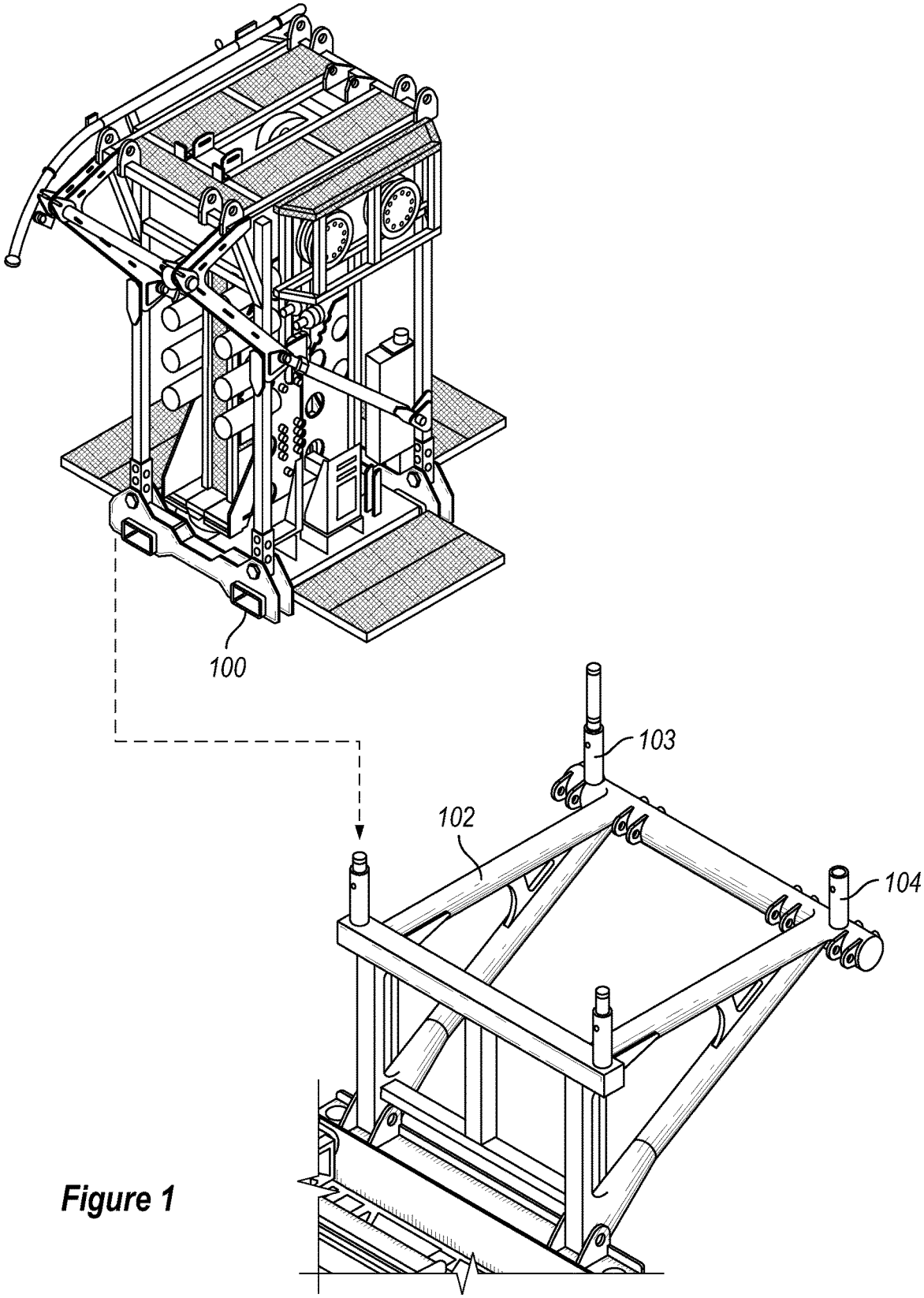
FIG. 1 is a graphic of the interface between a tilt and an injector according to certain embodiments.
Figure 2:
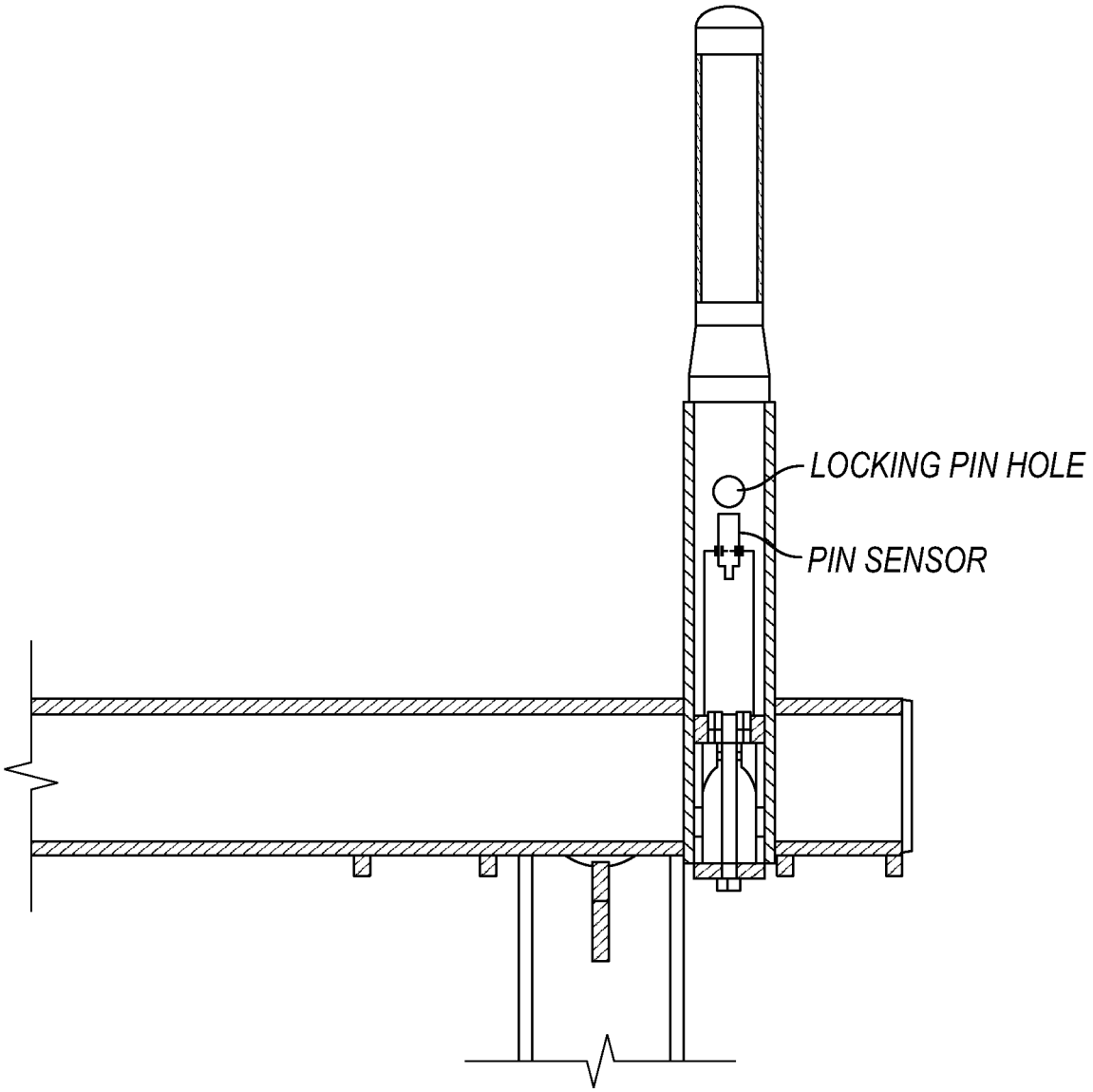
FIG. 2 is a cross section of the interface showing a sensor installed to detect that the injector locking pin is installed.
Figure 3:
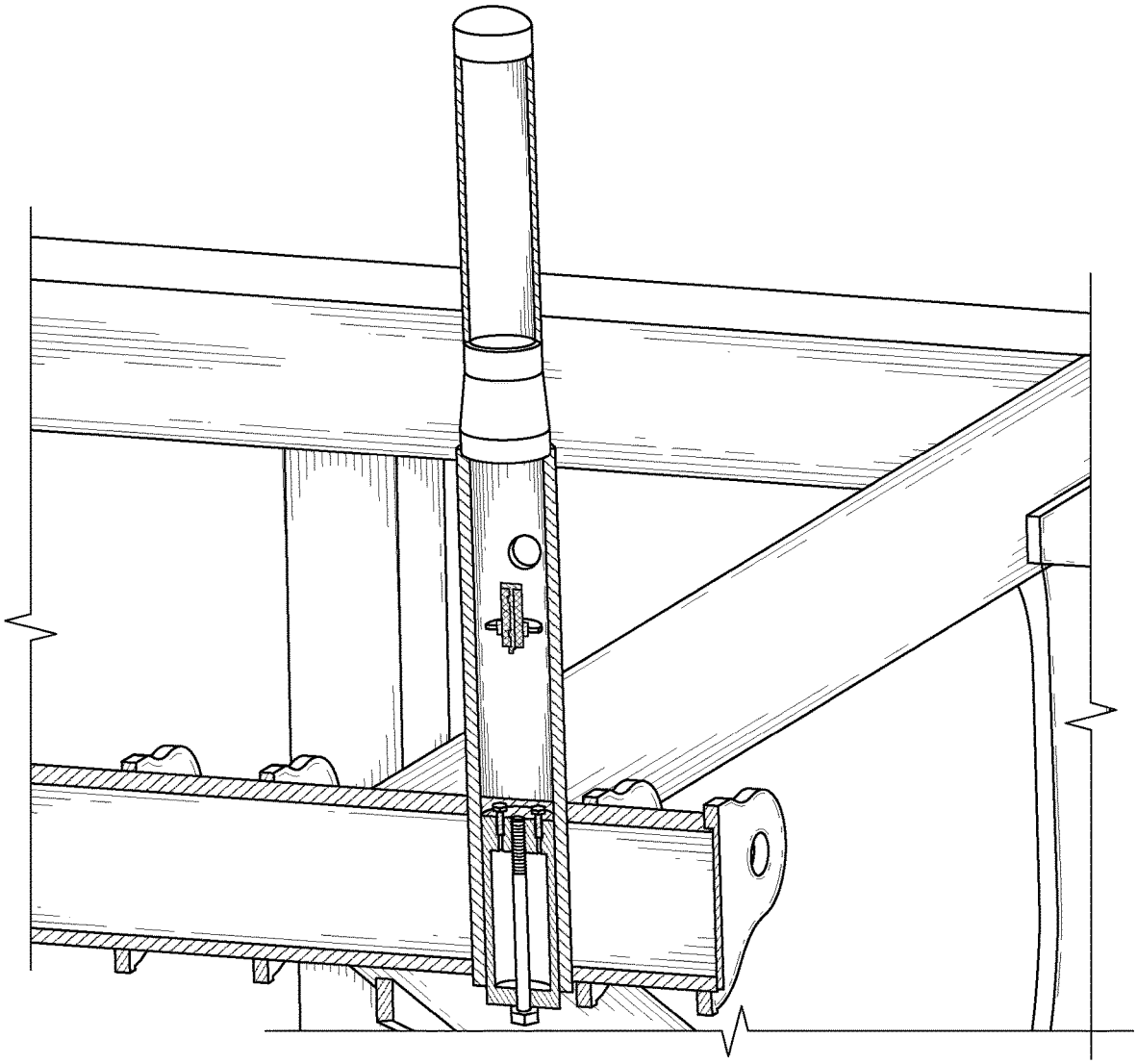
FIG. 3 is a cross section of the interface showing a sensor installed to detect that the injector locking pin is installed in a model view.

The storage of the injector during transport and the expeditious manner in which it is deployed, have been paramount to cost effective coil tubing operations. The height of the injector eliminates the ability to store the injector vertically on a trailer due to highway height restrictions. Therefore, the coil tubing injector is most often stored at an angle to reduce height, horizontally, or at any angle in-between vertical and horizontal.

A negative factor of mounting the injector horizontally is that the coiled tubing injector can be prone to removal from its cradle due to weight, or shift of the tubing length or pressure from the tubing on the reel. To maximize efficiency, the tubing remains stabbed or placed within the injector during transport. Un-stabbing and Re-stabbing, is a time consuming effort, may be inherently dangerous to personnel, and often requires hours of time which is vital for efficiency. The tubing remaining in the injector is susceptible to the force from the reel. As the injector is positioned for storage on a trailer, the tubing is reeled back onto the reel. The reel is essentially paying in the slack. As the injector is tilted towards the front of the trailer for storage, more slack is developed by the tubing. In order to maintain a good control over the tubing, the slack must be reeled in, so that the remaining distance of tubing is not taller than the reel or injector. If the injector is not secured to the cradle, the injector could be pulled from the cradle towards the reel and fall onto the trailer or a person.

Previously, a manual pin lock was inserted into each leg of the cradle. Unfortunately, when a human does not physically attach a retaining pin to each leg, the injector may be ejected from its mount resulting in dangerous and/or costly damage.

The embodiments of the present application eliminates the need for a manual locking appliance and any associated human error or malfunctions by incorporating a detector in the injector cradle to ensure securement. In this manner a failsafe method is ensured which does not allow the injector to be tilted until all mechanical locks are engaged into each leg of the injector tilt thereby safely securing the injector from any movement off of the tilt.

As shown in the figures, the Coiled tubing injector (100) is placed on the injector tilt (102), which is mounted on the trailer (101). Each of the mounting legs (103) are configured to slide into corresponding preformed openings on the injector (100). A securement pin is then entered into each leg opening (104), to secure the injector (100).

A sensing device or sensor is employed within the injector tilt (102) and the sensor may be incorporated in the mounting legs (103) or openings (104) or both to indicate that a pin or any other securement device is in place to prevent injector movement. The sensing device or sensor may take many forms and thus may, for example, be mechanical, optical, pneumatic, hydraulic, and/or magnetic. The sensor may be configured to transmit a signal to (1) a controller operably connected to a valve and/or (2) directly to a valve. In this manner, once the sensor has detected that the injector is secured, the valve may safely lower the injector. If the sensor does not detect securement of each leg and/or the sensor detects a lack of securement from any of the legs, then the controller, valve, and/or system will not allow the injector to be tilted for transport. The signal from the sensor may be transmitted locally through any convenient method such as, for example, visual, auditory, or any other sensory based transmitted signal. In some embodiments the signal may be transmitted to a remote location. In some embodiments, the signal can be determined as successful or not successful from a location near or on the injector, coil trailer, or towing tractor. Additionally or alternatively, the signal may be transmitted to another party for action.

EMBODIMENTS

1. A coiled tubing injector system comprising:
   - a coiled tubing injector;
   - an injector tilt configured to be mounted to a trailer wherein the injector tilt is configured to receive the coiled tubing injector;
   - a securing mechanism to secure the coiled tubing injector to the injector tilt; and
   - at least one sensor configured to detect whether the securing mechanism is positioned to substantially secure the coiled tubing injector to the injector tilt;

wherein the system is configured such that the injector can only be tilted if the sensor detects that the securing mechanism is positioned to substantially secure the coiled tubing injector to the injector tilt.

2. The system of embodiment 1, wherein the injector tilt comprises a plurality of legs, the coiled tubing injector comprises a plurality of openings configured to receive the plurality of leg and wherein the securing mechanism comprises a plurality of pins configured to secure the plurality of legs to the plurality of openings.

3. The system of embodiment 2, wherein the at least one sensor is located in the plurality of legs, the plurality of openings, or both.

4. The system of embodiment 2, wherein the at least one sensor is a mechanical sensor, an optical sensor, a pneumatic sensor, a hydraulic sensor, a magnetic sensor, or a combination thereof.

5. The system of embodiment 2, wherein the at least one sensor is configured to transmit a signal to a controller, a valve, or a combination thereof.

6. The system of embodiment 5, wherein the signal allows the system to tilt the injector.

7. The system of embodiment 5, wherein the signal prevents the system from tilting the injector.

8. The system of embodiment 5, wherein the signal is a visual or audio signal indicating the securing mechanism is positioned to substantially secure the coiled tubing injector to the injector tilt.

9. The system of embodiment 5, wherein the signal is a visual or audio signal indicating the securing mechanism is not positioned to substantially secure the coiled tubing injector to the injector tilt.

10. A coiled tubing injector system comprising:

a coiled tubing injector;

an injector tilt configured to be mounted to a trailer wherein the injector tilt is configured to receive the coiled tubing injector;

a securing mechanism to secure the coiled tubing injector to the injector tilt; and at least one sensor configured to detect whether the securing mechanism is positioned to substantially secure the coiled tubing injector to the injector tilt;

wherein the system is configured such that the sensor detects whether the securing mechanism is positioned to substantially secure the coiled tubing injector to the injector tilt and transmits a signal indicating that (1) the securing mechanism is positioned to substantially secure the coiled tubing injector to the injector tilt or (2) the securing mechanism is not positioned to substantially secure the coiled tubing injector to the injector tilt.

The invention claimed is:

1. A coiled tubing injector system comprising:

a coiled tubing injector;

an injector tilt configured to be mounted to a trailer wherein the injector tilt is configured to receive the coiled tubing injector;

a securing mechanism to secure the coiled tubing injector to the injector tilt; and at least one sensor configured to detect whether the securing mechanism is positioned to substantially secure the coiled tubing injector to the injector tilt;

wherein the system is configured such that the injector can only be tilted if the sensor detects that the securing mechanism is positioned to substantially secure the coiled tubing injector to the injector tilt.

2. The system of claim 1, wherein the injector tilt comprises a plurality of legs, the coiled tubing injector comprises a plurality of openings configured to receive the plurality of legs, and wherein the securing mechanism comprises a plurality of pins configured to secure the plurality of legs to the plurality of openings.

3. The system of claim 2, wherein the at least one sensor is located in the plurality of legs, the plurality of openings, or both.

4. The system of claim 2, wherein the at least one sensor is a mechanical sensor, an optical sensor, a pneumatic sensor, a hydraulic sensor, a magnetic sensor, or a combination thereof.

5. The system of claim 2, wherein the at least one sensor is configured to transmit a signal to a controller, a valve, or a combination thereof.

6. The system of claim 5, wherein the signal allows the system to tilt the injector.

7. The system of claim 5, wherein the signal prevents the system from tilting the injector.

8. The system of claim 5, wherein the signal is a visual or audio signal indicating the securing mechanism is positioned to substantially secure the coiled tubing injector to the injector tilt.

9. The system of claim 5, wherein the signal is a visual or audio signal indicating the securing mechanism is not positioned to substantially secure the coiled tubing injector to the injector tilt.

10. A coiled tubing injector system comprising:

a coiled tubing injector;

an injector tilt configured to be mounted to a trailer wherein the injector tilt is configured to receive the coiled tubing injector;

a securing mechanism to secure the coiled tubing injector to the injector tilt; and at least one sensor configured to detect whether the securing mechanism is positioned to substantially secure the coiled tubing injector to the injector tilt;

wherein the system is configured such that the sensor detects whether the securing mechanism is positioned to substantially secure the coiled tubing injector to the injector tilt and transmits a signal indicating that the securing mechanism is positioned to substantially secure the coiled tubing injector to the injector tilt or the securing mechanism is not positioned to substantially secure the coiled tubing injector to the injector tilt.

* * * * *